US006976545B2

(12) United States Patent
Greitmann

(10) Patent No.: US 6,976,545 B2
(45) Date of Patent: Dec. 20, 2005

(54) DEVICE FOR SWITCHING OPERATING MODE FOR HAND TOOL

(75) Inventor: Ralf Greitmann, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/353,430

(22) Filed: Jan. 29, 2003

(65) Prior Publication Data

US 2003/0146007 A1 Aug. 7, 2003

(30) Foreign Application Priority Data

Feb. 7, 2002 (DE) ..... 102 05 030

(51) Int. Cl.[7] ..... B25D 17/00
(52) U.S. Cl. ..... 173/104; 173/47; 173/109; 173/201
(58) Field of Search ..... 173/47, 48, 104, 173/109, 201

(56) References Cited

U.S. PATENT DOCUMENTS 3,774,699 A * 11/1973 Schmuck ..... 173/48
4,066,136 A * 1/1978 Wanner et al. ..... 173/48
4,236,588 A 12/1980 Moldan et al.
4,763,733 A * 8/1988 Neumaier ..... 173/48
4,825,961 A * 5/1989 Neumaier et al. ..... 173/109
5,346,023 A * 9/1994 Takagi et al. ..... 173/178
5,456,324 A * 10/1995 Takagi et al. ..... 173/48
6,176,321 B1 * 1/2001 Arakawa et al. ..... 173/48
6,192,996 B1 * 2/2001 Sakaguchi et al. ..... 173/48

FOREIGN PATENT DOCUMENTS

| | | |
|---|---|---|
| DE | 3804414 | 2/1988 |
| DE | 4009762 | 3/1990 |
| JP | 9239675 | 3/1996 |

* cited by examiner

*Primary Examiner*—Louis K. Huynh
*Assistant Examiner*—Nathaniel Chukwurah
(74) *Attorney, Agent, or Firm*—Abelman, Frayne, Schwab

(57) ABSTRACT

A device for switching operating modes for an at least partially rotational and percussive hand tool machine having an overload clutch, which is arranged between a hollow driving guide cylinder (3) containing an axially striking impact piston (2) and a rotating, driving crown gear (4) on the guide cylinder (3) and which can be switched into different operating modes using an externally manually switchable, axially displaceable switching member, wherein at least one operating mode is rotationally driven, wherein the axially displaceable switching member engages rotationally form-lockingly into a freely rotational coupling ring (6) of the overload clutch mounted relative to the guide cylinder (3).

9 Claims, 3 Drawing Sheets

DEVICE FOR SWITCHING OPERATING MODE FOR HAND TOOL

BACKGROUND OF THE INVENTION

The invention relates to a device for switching operating modes for an at least partially rotational and percussive hand tool machine such as a combi-hammer.

U.S. Pat. No. 4,236,588 discloses a hammer drill that comprises an external manually operated, axially displaceable sliding cylinder that is mounted rotationally and locked on the guide cylinder. The sliding cylinder is provided with a dog catch, which in a first operating mode fixes the guide cylinder locked against rotation relative to the housing, in a second operating mode freely rotational and in a third operating mode relative to a bevel gear.

DE4009762 discloses a chisel hammer having a two-part guide cylinder that can be rotationally adjustable and fixed using locking balls both engaging radially and a spring-biased, external axial manual displaceable sliding sleeve.

Torque limiters or overload clutches are used in the power transmission train for mechanically limiting unacceptable torque, in particular, for tool blockage.

DE3804414 discloses a drill hammer having a spring-biased overload clutch connected with the tool receptacle between the hollow driving guide cylinder containing an axially striking driving piston, said guide cylinder being locked against rotation, and a driving bevel gear mounted rotationally on the guide cylinder. The overload clutch can be snapped in again after its release on overload using an external manually operated, axially displaceable sliding sleeve.

JP9239675 discloses a drill hammer having an overload clutch comprising two opposing axially spring biased mutually interlocking coupling rings that are arranged between the hollow driving guide cylinder containing an axially impacting driving piston and a driving crown gear rotationally mounted on the guide cylinder and which is driven via an additional intermediate shaft having three external manually switchable operating modes.

SUMMARY OF THE INVENTION

The object of the invention is to provide a simple realization of an operating mode switching device manually switching a hand tool device in three operating modes and having a manual overload clutch.

This object is essentially achieved, in accordance with the invention, by a device for switching operating modes for an at least partially rotational and percussive hand tool machine with at least three operating modes having an overload clutch, which is disposed between a hollow, driving guide cylinder containing an axially impacting driving piston and a driving crown gear and which can be switched using an external manually switchable, axially displaceable switching member into different operating modes, whereby the guide cylinder is rotationally driven in at least one operating mode. The axially displaceable switching member rotationally form-lockingly engages in a freely rotating coupling ring of the overload clutch relative to the guide cylinder.

The driving coupling ring combines the operating mode switching device in a technically simple manner with a torque-dependent overload clutch by virtue of the axially displaceable switching member being rotationally form-lockingly engaged in the driving coupling ring of the overload clutch and thus results in a reduction of structural parts.

The overload clutch preferably comprises two opposing, axially spring biased friction lockingly interlocking coupling rings, whereby the springs may be configured in a structurally simple fashion around the guide cylinder.

Preferably, the driving coupling ring is pre-biased by the axial spring relative to the guide cylinder and mounted rotationally locked, and axially limited moveable relative to the guide cylinder, whereby the freely rotating driving coupling ring is in an axially fixed positioned.

Preferably, the axially displaceable switching device, which is preferably configured as a sliding sleeve, is rotationally form-lockingly connected with a driving coupling ring via radial projections and associated radially disposed grooves, whereby the engagement is axially freely moveable.

Preferably, the axially displaceable sliding sleeve can be rotationally form-lockingly connected at a first frontal end with a driving crown gear via radial projections and associated grooves, whereby one operating mode having a rotary drive such as "hammer drilling" can be switched.

Preferably, the axially displaceable sliding cylinder is shorter than the engaging distance between the driving crown gear and the locking ring fixed to the housing, whereby an operating mode fixed against rotation such as "chisel" can be switched.

Preferably, the axially displaceable sliding cylinder can be spring biased against the freely rotational coupling ring, whereby a synchronized switching between the operating modes relative to the rotationally form locking engagement is possible.

Preferably, the axially displaceable sliding sleeve is radially stepped, whereby the axial stop for the sliding spring is formed.

BRIEF DESCRIPTION OF THE INVENTION

The preferred embodiment of the invention is explained in more detail below with reference to the following figures, wherein.

DETAILED DESCRIPTION OF THE INVENTION

Figure 1:
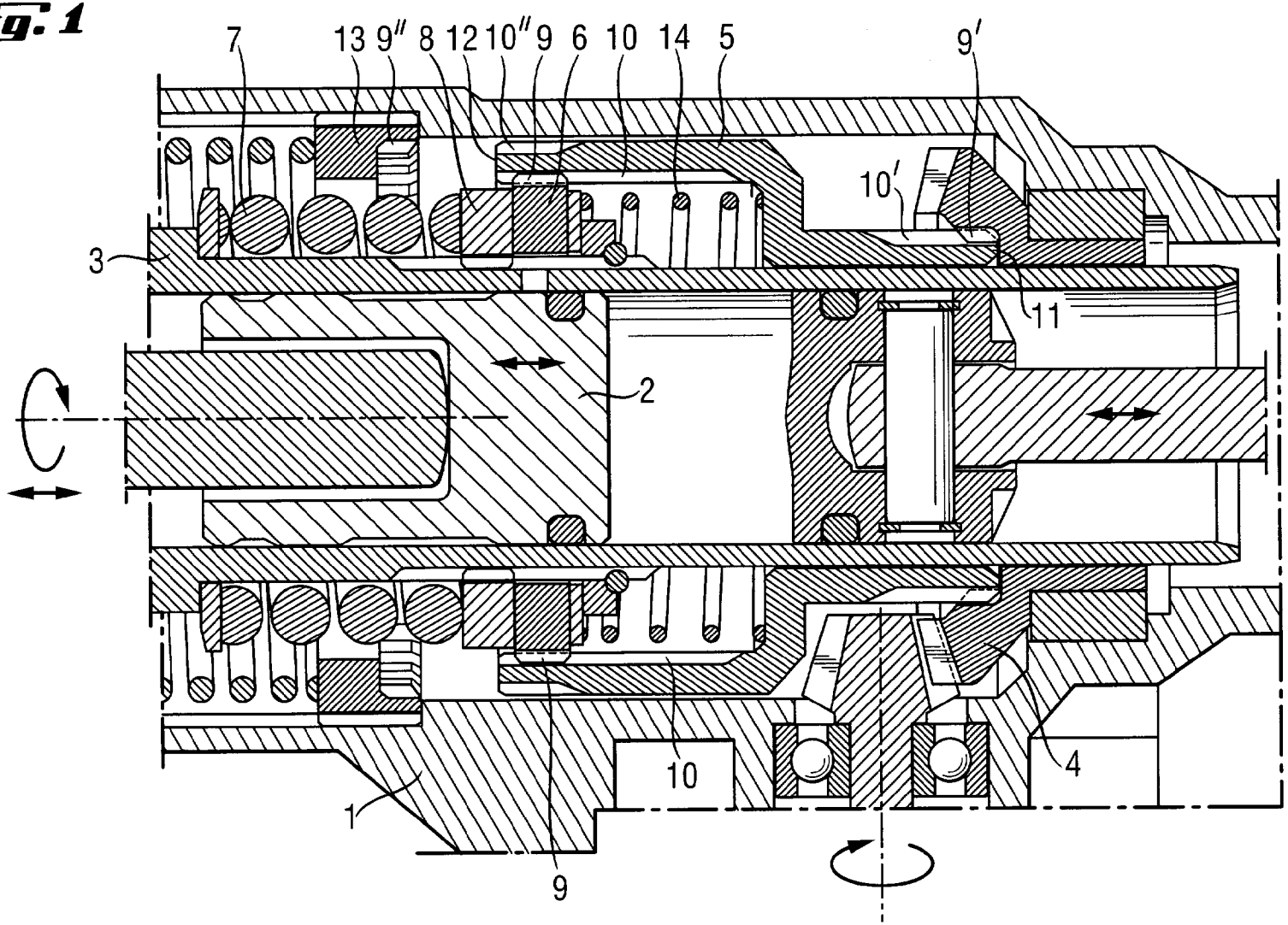
FIG. 1 shows an operating mode switching device in Mode I.

FIG. 1 shows a device for switching operating modes of a rotating and striking hand tool machine (not shown) comprising an overload clutch having a housing 1, which is arranged between a hollow driving guide cylinder 3 containing an axially striking impact piston 2 and a driving crown gear 4 that can be rotated on the guide cylinder 3, whereby a sliding cylinder 5 that is axially displaceable and externally manually switched using a handle, is rotationally form lockingly mounted in driving coupling ring 6 of the overload coupling freely rotating relative to the guide cylinder 3. The overload clutch comprises the driving coupling ring 6 fixed axially relative to the guide cylinder 3 and an axially limited displaceable mounted driving coupling ring 8 locked against rotation, wherein the coupling ring can be axially frictionally interlocked according to the claw principle. The axially displaceable, peripherally radially offset sliding cylinder 5 is rotationally form lockingly connected with the driving coupling ring 6 using radial projections 9 and associated radial grooves 10. In the illustrated operating mode with rotational drive, the axially offset sliding cylinder 5 is connected at a first frontal end 11 with the driving crown gear 4 using radial projection 9' and associated grooves 10'.

Figure 2:
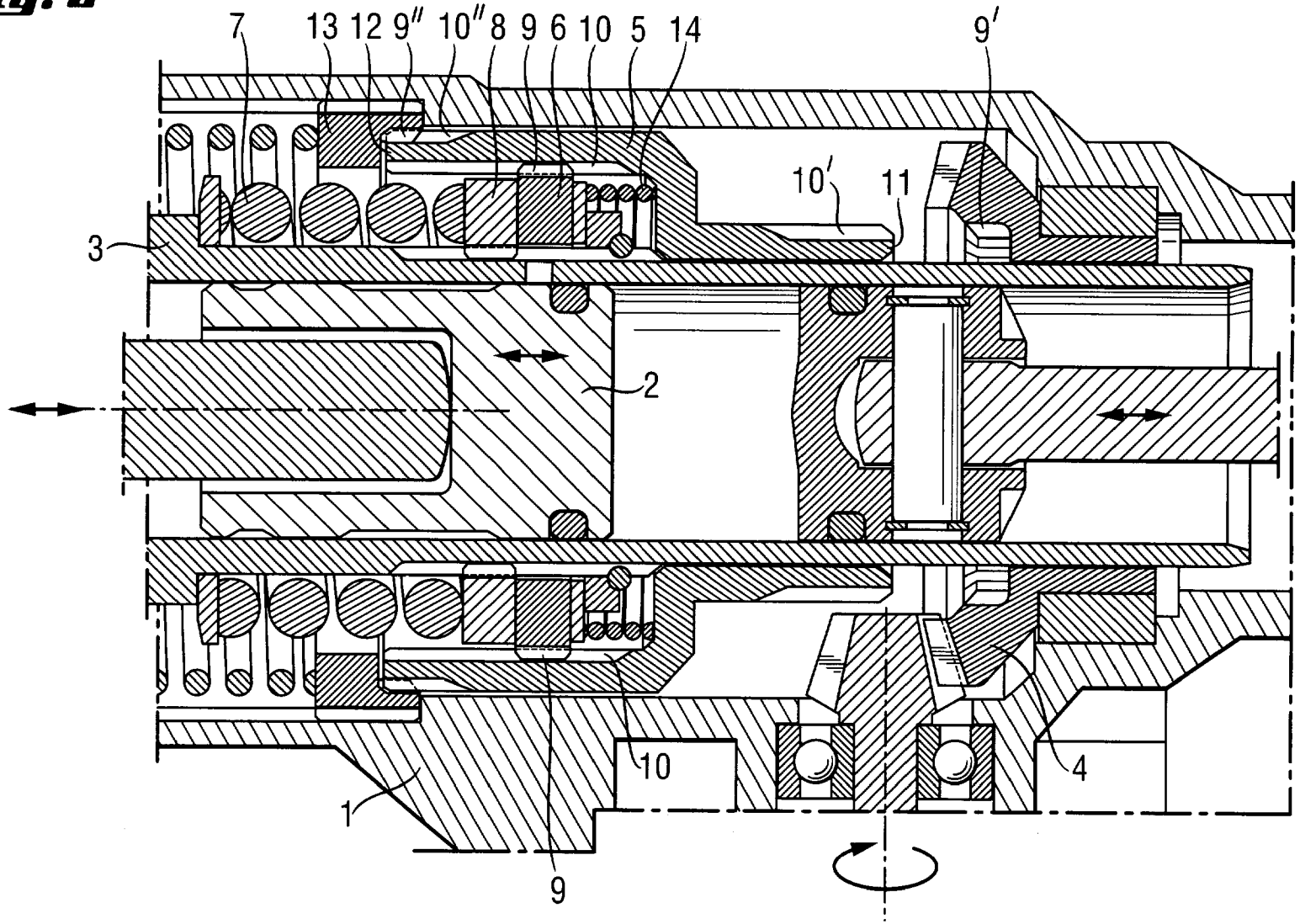
FIG. 2 shows the device of FIG. 1 in Mode II.

FIG. 2, shows an operating mode with a rotation lock, wherein the axially displaceable sliding cylinder 5 is rotationally form lockingly connected at a second frontal end 12 with a locking ring 13 fixed to the housing using radial projection 9" and associated grooves 10".

Figure 3:
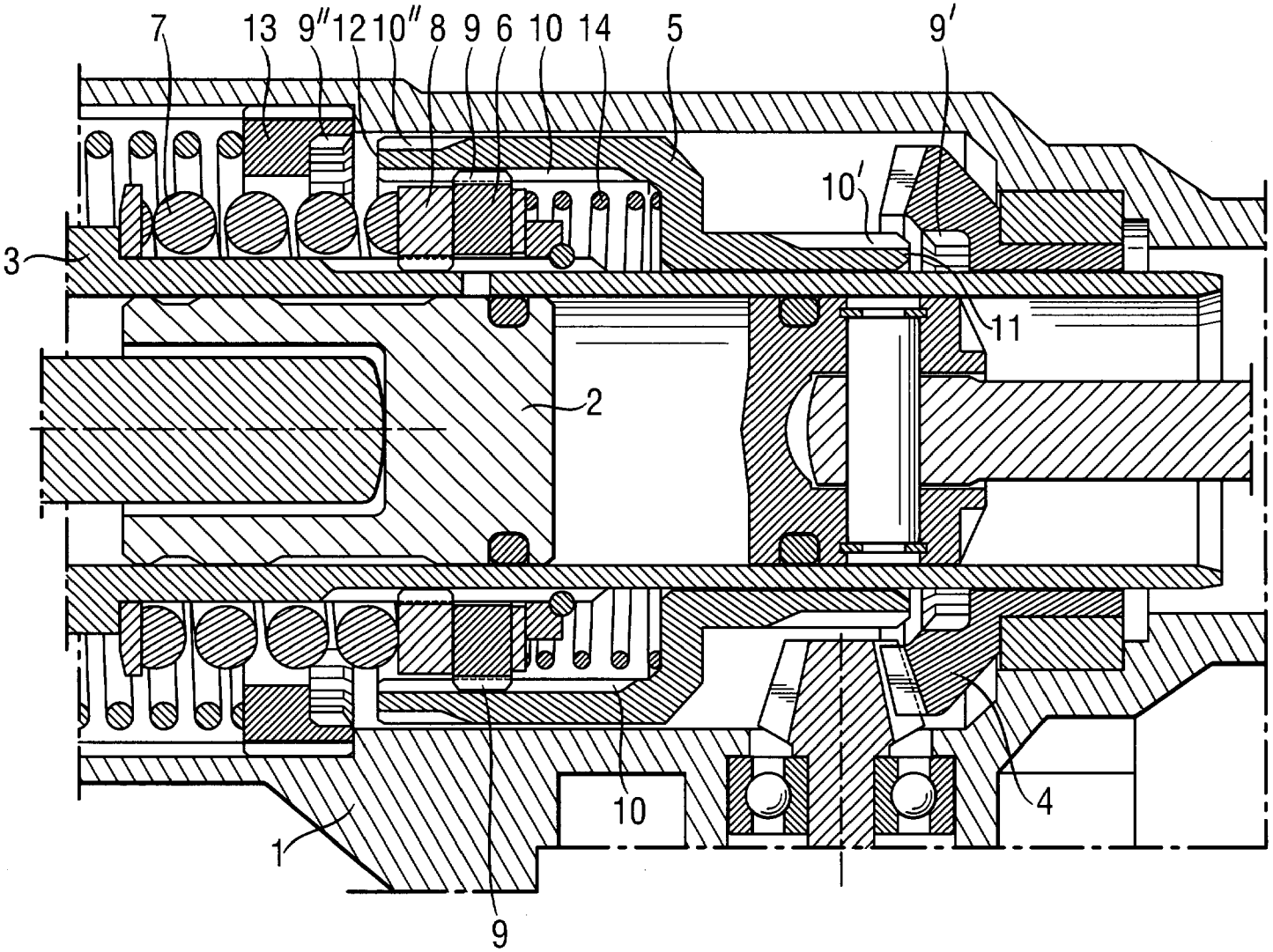
FIG. 3 shows the device of FIG. 1 in Mode III.

In FIG. 3, the centrally positioned, axially displaceable sliding cylinder 5 is shorter than the engaging distance between the driving crown gear 4 and the locking ring 13, whereby in the illustrated freely rotating operating mode there is no engagement. The radially stepped sliding cylinder 5 is axially spring biased using a sliding spring 14 against the rotational freely rotating coupling ring 6.

What is claimed is:

1. A device for switching operating modes for an at least partially rotating and percussive hand tool machine comprising:

a hollow driving guide cylinder;

a rotationally driving crown gear disposed on said hollow driving guide cylinder; an axially striking piston in said hollow driving guide cylinder;

an overload clutch arranged between said hollow driving guide cylinder and said rotationally driving crown gear; and an external manual switchable, axially displaceable switching member for switching said overload clutch into different operating modes;

wherein said overload clutch comprises two opposing axially friction-lockingly interlock coupling rings by means of an axial spring; and wherein in at least an operating mode the hollow driving guide cylinder is rotationally driven, the switching member engage rotationally form-lockingly into one of the coupling ring of the overload clutch that is freely mounted rotationally relative to said hollow driving guide cylinder.

2. The device of claim 1, wherein the other interlocking coupling ring of the overload clutch is biased using the axial spring relative to the guide cylinder and mounted axially and limitedly moveable, locked against rotation relative to the guide cylinder.

3. The device of claim 1, wherein the axially displaceable switching member is rotationally form-lockingly connected with the driving coupling ring (6) using radial projections (9) and associated radial grooves (10).

4. The device of claim 1, wherein the axially displaceable switching member is a sliding sleeve (5).

5. The device of claim 4, wherein the axially displaceable sliding sleeve (5) is rotationally form-lockingly connected at one first frontal end (11) with the driving crown gear (4) using radial projections (9') and associated grooves (10').

6. The device of claim 5, wherein the axially displaceable sliding sleeve (5) is rotationally form-lockingly connected at a second frontal end (12) with a locking ring (13) fixed to the housing using radial projections (9") and associated grooves (10").

7. The device of claim 6, wherein the axially displaceable sliding sleeve (5) is shorter than the engaging distance between the driving crown gear (4) and the locking ring (13) fixed to the housing (1).

8. The device of claim 7, wherein the axially displaceable sliding sleeve (5) is axially biased against the freely rotational coupling ring (6) by a sliding spring (14).

9. The device of claim 8, wherein the axially displaceable sliding sleeve (5) is radially stepped.

* * * * *